US005199133A

United States Patent [19]

Burton

[11] Patent Number: 5,199,133

[45] Date of Patent: Apr. 6, 1993

[54] LINT CLEANER FEEDING ROLLERS

[76] Inventor: Jimmy L. Burton, Rt. 3 Box 396, Bells, TN 38006

[21] Appl. No.: 762,621

[22] Filed: Sep. 19, 1991

[51] Int. Cl.[5] ..... D01B 1/06

[52] U.S. Cl. ..... 19/39; 19/64.5

[58] Field of Search ..... 19/39, 48 R, 50, 52, 19/53, 55 R, 55 B, 56, 57, 59, 60, 62 A, 64.5, 96, 40, 41, 42, 43

[56] References Cited

U.S. PATENT DOCUMENTS

| | | | |
|---|---|---|---|
| 832,707 | 10/1906 | Thomas | 19/48 R |
| 961,624 | 6/1910 | Lumpkin | 19/59 |
| 1,180,132 | 4/1916 | Garner | 19/96 |
| 1,216,673 | 2/1917 | Ellenburg | 19/57 |
| 1,242,271 | 10/1917 | Thompson | 19/39 |
| 1,406,094 | 2/1922 | Simpson | 19/59 |
| 1,574,344 | 2/1926 | Garner | 19/59 X |
| 1,612,732 | 12/1926 | Kinne | 19/96 |
| 2,418,694 | 4/1947 | Brooks | 19/39 |
| 2,637,075 | 5/1953 | Rudy et al. | 19/96 |
| 2,747,235 | 5/1956 | Wallace | 19/39 X |
| 2,825,096 | 3/1958 | Moss | 19/57 X |
| 2,911,684 | 11/1959 | Hunter | 19/59 X |
| 3,543,350 | 12/1970 | Malkov | 19/50 |
| 4,126,913 | 11/1978 | Roberson | 19/96 |

FOREIGN PATENT DOCUMENTS

| | | | |
|---|---|---|---|
| 1377303 | 4/1988 | U.S.S.R. | 19/39 |
| 0021494 | 3/1913 | United Kingdom | 19/96 |
| 0835215 | 5/1960 | United Kingdom | 19/96 |

*Primary Examiner*—Clifford D. Crowder
*Assistant Examiner*—Israel Izaguirre
*Attorney, Agent, or Firm*—Wendell Coffee

[57] ABSTRACT

The traditional feed plate or stationary feed bar of a lint cleaner in a cotton gin is replaced by a rolling feed bar to press the cotton fibers onto the saw teeth of the saw cylinder. A rolling feed bar is a cylinder of about ¼ the diameter of the saw cylinder which is rotated to have a surface speed of about 1/25th (+ or −50%) of the surface speed of the saw cylinder. The rolling feed bar is a smooth aluminum roller which co-acts with a ribbed or splined steel roller.

7 Claims, 1 Drawing Sheet

LINT CLEANER FEEDING ROLLERS

BACKGROUND OF THE INVENTION (1) Field of the Invention

This invention relates to ginning cotton in a broad sense. I.e., the ginning process includes not only the separation of the seed and lint from seed cotton, but also the cleaning of trash from lint cotton after the seeds have been removed. Specifically, this invention relates to lint cleaning and more particularly to a rolling feed bar for feeding a layer of lint cotton to a saw cylinder of a lint cleaner.

(2) Description of the Related Art

Before this invention, lint cleaners in cotton gins were well known. See for example, HICKS #3,984,896 and HORN #4,528,725. Linter cleaners (See REDDICK #3,355,776) are somewhat related but have certain different considerations from lint cleaners used in cotton gins.

Due to the nature of harvest, modern cotton gins will have a capacity to process 5,000 to 25,000 pounds (2,250 to 11,500 kg) of lint an hour. Other considerations besides high capacity for a lint cleaner in a cotton gin are to remove trash from the cotton lint and also not to damage the cotton fiber. Prior to my invention the layer of lint cotton was fed to the saw teeth of the lint cleaner by a stationary press bar or feed plate. Also, the layer of cotton was pressed against the teeth by stationary bars such as seen in the HORN '725 patent as elements 70, 78, 80, and 82.

However, at high capacities, this often led to a condition called "nipping" or "napping". This particularly is identified by High Velocity Inspection (HVI) classing equipment. Cotton with excessive nipping or napping will have penalties assessed against it, reducing its sale price. This nipping or napping is twisting of the individual fibers of the lint. It is believed that they are primarily caused by these stationary bars pressing the layer of lint cotton into the saw teeth.

SUMMARY OF THE INVENTION (1) Progressive Contribution to the Art

It is to alleviate or prevent nipping or napping from occurring, that this invention was developed. The solution is to have a rolling feed bar or a rotating feed bar as the final element to feed the cotton to the saw teeth. The surface of this right circular cylinder is mounted as close as possible to the saw teeth without excessive force being transferred to the saw teeth with the layer of lint cotton between the rolling feed bar and the saw teeth.

It has been found that the surface speed of this bar need not be excessive. I.e., there is no reason for the surface of the rolling feed bar to approach that of the saw teeth. In fact, good success has been had with the rolling feed bar moving, at no more than about 1/25th of the speed of the saw teeth. I.e., while the saw teeth may travel at speeds of 5,000 feet (1500M) per minute, the surface of the feed bar travelling at 200 feet (about 60M) per minute greatly alleviates the problem of nipping or napping.

(2) Objects of this Invention

An object of this invention is to clean lint cotton.

Further objects are to clean lint cotton without damaging the fibers.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

Figure 1:
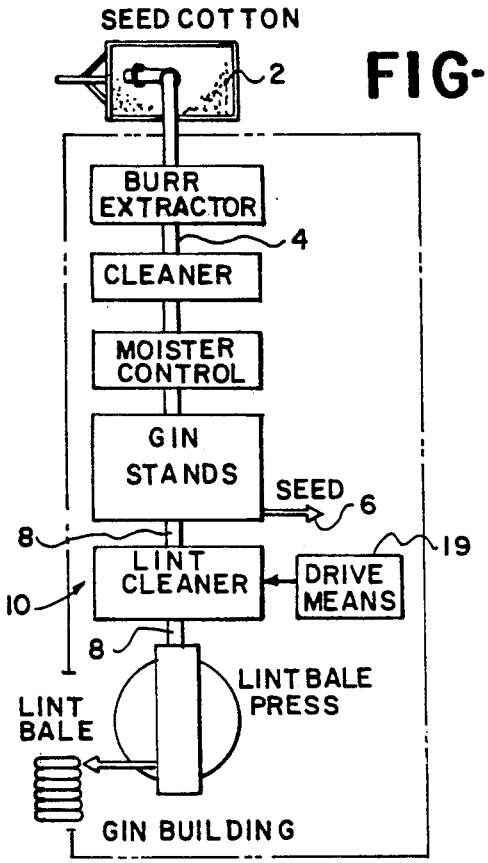
FIG. 1 is a schematic representation showing the process flow through a typical cotton gin.

As an aid to correlating the terms of the claims to the exemplary drawing(s), the following catalog of elements and steps is provided:

2 trailers
4 handling system
6 seed handling system
8 lint handling system
10 lint cleaner
12 lint cleaner condenser
14 rotating perforated drum
16 doffing roller
18 layer or batt
19 drive means
20 compression rollers
22 first pair of feed rollers
24 first pair of feed rollers
26 second pair of feed rollers
28 second pair of feed rollers
30 saw cylinder
32 saw teeth
34 grid bars
36 edge
38 reclaimer pan
40 doffing brush

DESCRIPTION OF THE PREFERRED EMBODIMENTS

FIG. 1 schematically describes a typical cotton gin process flow in which the applicants' invention is preferably employed. Seed cotton is harvested in the field and transported to the location of the cotton gin building in trailers 2 or other vehicles. At the gin, seed cotton handling system 4 receives the seed cotton and transports it to devices for removing green bolls from the seed cotton, controlling the moisture content of the seed cotton, and cleaning and extracting some foreign matter from the seed cotton, shown in FIG. 1 as "burr extractor", "cleaner" and "moisture control".

"Foreign matter" or "trash" refers to the cotton plant stalks, stems, leaves, bark, and boll pieces normally found in cotton delivered from the harvest site to a cotton gin. Foreign matter also may include small pebbles, dirt, sand, weeds, seeds and other trash picked up by harvesting equipment.

As used herein, the term "upstream" from any point means that the cotton or elements above that point are moving toward the point. The term "downstream" from any point indicates that the cotton or elements move away from that point.

The seed cotton is fed to one or more gin stands, where the seeds are separated from the lint cotton. The seeds are transported by seed handling system 6 to further processing or to storage for shipment.

The lint cotton is transported from the gin stands by lint handling system 8 to lint cleaner 10. Although foreign matter may be removed before the seed cotton is transported to the gin stands, as described above, the lint cotton leaving the gin stands still contains substantial amounts of foreign matter.

The lint cotton is transported or conveyed from the lint cleaner to a packaging system, or press means, for compressing the lint cotton into dense bales. A typical press means consists of a condenser, lint slide, feeder, tramper, bale press, and strapping bale tying machine, shown in FIG. 1 as "lint bale press". The lint cotton emerges from the press means as a dense, somewhat rectangular lint cotton bale held together with metal ties, and weighing about 480 to 500 pounds. The bales are then shipped to compresses or to textile mills for further processing. The gin building preferably encloses the gin equipment described above under a roof at one location.

The seed cotton handling system 4 forms receiver means for receiving seed cotton into the gin building, and forms transport means for transporting the received seed cotton to the gin stands. The gin stands form gin stand means for separating lint fibers from seeds of the seed cotton. The lint handling system 8 forms conveyor means for conveying or transporting the lint cotton fibers from the gin stands to the lint cleaner, and from the lint cleaner to the lint bale press. The lint bale press forms press means for pressing or compressing the lint cotton into a dense bale.

Figure 2:
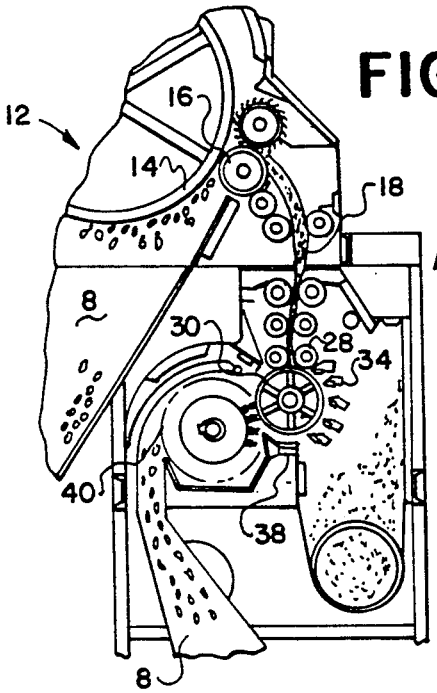
FIG. 2 is a cross-section figure showing a lint cleaner according to this invention.
Figure 3:
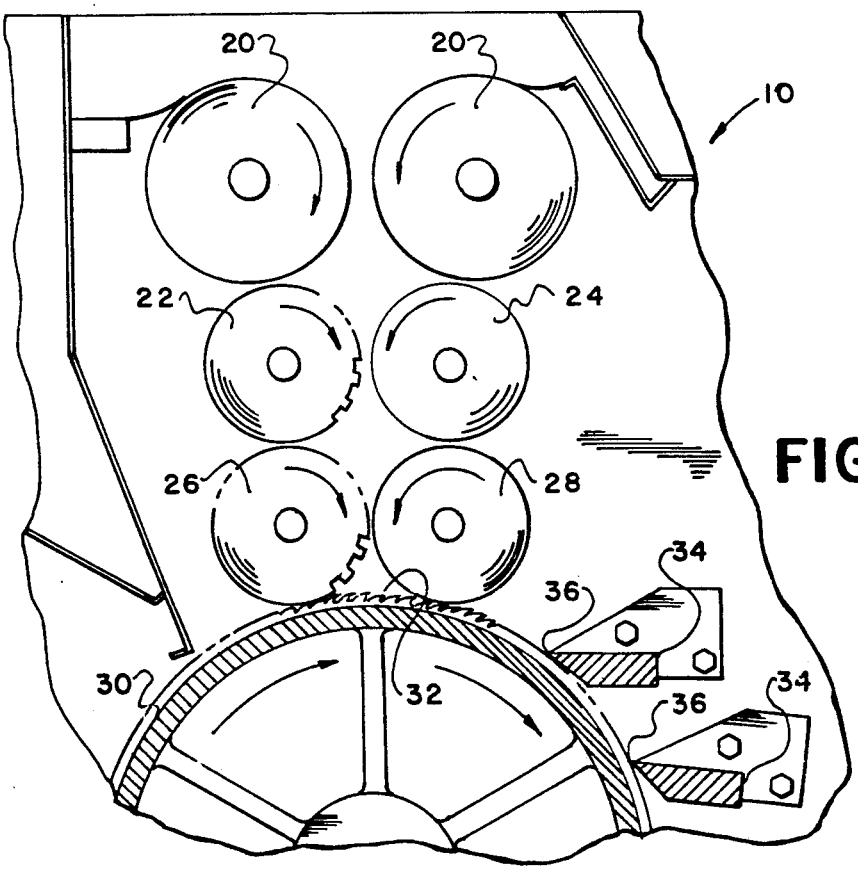
FIG. 3 is an enlarged detail of the feed rollers of the lint cleaner.

FIG. 2 shows a cross-section area of a lint cleaner together with the lint cleaner condenser 12. The lint cleaner condenser is a different machine from the condenser associated with the lint bale press. Basically it will include rotating perforated drum 14 so that the air may be separated from the lint. The lint is removed from the drum by doffing roller 16. Then it is conveyed by other rollers to the lint cleaner 10. At the lint cleaner 10 the cotton is received as a layer or batt 18 of lint. The layer or batt is passed through a pair of compression rollers 20. The compression rollers are rotated in the direction as shown in FIG. 3 so that the surface thereof moves at a speed of about 187 feet (57M) per minute. Immediately below the compression rollers are first pair of feed rollers 22 and 24. These feed rollers are also connected to drive means 19 so that their surface speed as shown by the arrows, is about 200 feet (60M) per minute.

Immediately below the first pair of feed rollers is second pair of feed rollers 26 and 28. The second pair of feed rollers are above saw cylinder 30. The cylinder is mounted for rotation about a cylindrical axis extending along a cylinder length. A plurality of saw teeth 32 are attached to and spaced axially and radially over the cylinder. The drive means 19 provides means for rotating this saw cylinder so that the surface of the saw cylinder moves at a speed of about 5,250 feet per minute. The saw cylinder rotates in the direction as shown by the arrows in FIG. 3. The saw teeth are inclined in the direction of tooth movement which is the same as the cylinder movement. The feed means including the rollers 20, 22, 24, 26, and 28, form a means for feeding a substantially continuous layer of lint cotton to the saw teeth.

A plurality of grid bars 34 extend along the saw cylinder length. Each grid bar has edge 36 in close proximity to the saw teeth.

The layer of cotton is engaged by the plurality of saw teeth 32 on the cylinder 30 and moved as a layer on the saw teeth beneath the grid bars 34. The edge 36 of each grid bar disturbs the lint fibers on the layer of the grid bar edge and loosens the foreign material from the layer so the foreign material is moved away from the saw cylinder, as is well understood in the art.

Also, downstream or in the direction of movements from the last of the grid bars 34 is reclaimer pan 38 which holds the lint on the saw teeth toward doffing brush 40. The surface of the doffing brush will move at a speeds substantially higher than the surface speed of the saw teeth 32, thereby doffing the cotton from the saw teeth as is well known in the art. From the doffing brush, the lint is conveyed by the system 8 to the lint bale press as is well known in the art.

The speed of the saw cylinder is substantially constant. Different operators may prefer different speeds, in fact the speed may be 5,000 feet (1500M) per minute or even slower. The speed of the drum 14 and its doffing roller 16 and the speed of compression rollers 20 and the feed rollers 20, 22, 24, 26, and 28, are normally driven from a common source which is adjustable. The drive means for these elements will be a portion of the drive means 19. The exact speeds of these elements may vary as much as 50% from the values given. That is the surface speed of the roller may be from 1/12 to 1/37 the surface speed of the saw cylinder. Conversely, the saw cylinder may rotate twelve to thirty seven times faster than the feed roller. The speed at which they are run will vary from operation to operation depending on the amount of lint cotton being ginned by the gin stands. Also it will depend on the particular condition of the cotton which would include the staple length, moisture percentage, fiber strength, and the like.

The main criteria of adjusting the speed of the feed rollers and the upstream equipment from the feed rollers is to prevent the cotton batt from balling up before it is fed to the saw cylinder, and also to present a good layer or batt of cotton to the saw cylinder. It is desired that an uncompressed batt or layer, being a uniform layer of about 1 inch (25 mm) thick, be fed to the saw cylinder.

Those having skill in the cotton ginning arts will understand the invention as described to this point as conventional and well known.

The compression rollers 20 are about 6" in diameter and are smooth aluminum rollers which extend along and for a length about equal to the length of the saw cylinder 30. The upstream feed roller 22 of the first pair of feed rollers is a splined or ribbed aluminum roller about 4½" (115 mm) in diameter. The downstream roller 24 of the first pair of feed rollers is a 4½" (115 mm) smooth aluminum roller. The upstream roller 26 of the second pair of feed rollers is a 4½" (115 mm) splined or ribbed steel roller. The downstream roller 28 of the second pair of feed rollers is a smooth aluminum feed roller. The smooth aluminum feed roller 28 is my unique contribution to lint cleaners.

As discussed above, previous to my invention, a stationary brush or block was used where I place the feed roller 28. The surface of feed roller 28 moves along in the same direction as the direction of the saw teeth 32 adjacent thereto. The surface of the roller 28 moves at a speed of about 1/25th of the speed of the saw teeth. By this movement, as well as the circular surface configuration of the cylinder roller 28, the layer of lint cotton is fed to teeth 32 so that the cotton is able to flow smoothly and evenly onto the saw cylinder 30. The feed roller 28 is also called a rolling feed bar.

A function of the roller 28 is to press the layer 18 of lint cotton onto the teeth 32.

The surface of the roller 28 is mounted close to the teeth 32. Because the roller 28 and cylinder 30 are several feet in length and rotating at high speeds, it is disastrous to have the surface of the roller 28 contact the teeth 32. Therefore a clearance of about 5/64 inch (2 mm) is provided between the surface of roller 28 and the teeth 32.

As pointed out above, the stationary feed bar previously used caused a certain amount of napping or nipping which is twisted, curled, cotton fibers. According to this invention the rolling feed bar does not cause any nips; the result is a better grade of cotton when the cotton is graded by High Velocity Inspection equipment.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

Subject matter claimed for protection:

1. In a lint cleaner in a cotton gin having a) a cotton gin building, b) receiver means for receiving seed cotton into the gin building which encloses c) transport means for transporting the seed cotton from the receiver means to d) gin stand means for separating seeds and lint from the seed cotton, and e) lint conveyor means for conveying the lint cotton from the gin stand means to the lint cleaner and for conveying the lint cotton from the lint cleaner to f) press means for pressing the cotton lint into dense cotton bales, g) the lint cleaner having h) a saw cylinder mounted for rotation about a cylinder axis extending along a cylinder length, i) a plurality of saw teeth attached to the circumferential surface of the cylinder, j) drive means for rotating the saw cylinder, so that the surface thereof has a saw cylinder circumferential surface speed, k) the saw teeth inclined in a direction of tooth movement during cylinder rotation, and l) a feed means for feeding a substantially continuous layer of lint cotton to the saw teeth, and m) a plurality of grid bars extending the length of saw cylinder with n) an edge of each grid bar in close proximity to the saw teeth;

wherein an improvement in the feed means for feeding the layer of lint cotton to the saw teeth comprises in combination with the above;

o) feed rollers adjacent to the saw teeth, one of said rollers which is smooth having about 2 mm clearance to the saw teeth for pressing the layer of lint cotton onto the saw teeth, and p) feed drive means for rotating the feed rollers so that the surface of the smooth feed roller moves in the same direction and has a feed surface speed of at least about 1/37th of the saw surface speed.

2. The lint cleaner as defined in claim 1 wherein said feeder drive means rotates said smooth feed roller at a speed not faster than about 1/12 the saw surface speed.

3. The lint cleaner as defined in claim 1 wherein said drive means rotates said feed roller at about 1/25 of the saw surface speed.

4. In a process for cleaning lint cotton including the steps of:

a) receiving seed cotton into a gin building, b) transporting the seed cotton to gin stands, c) then separating seeds and lint cotton from the seed cotton with the gin stands, d) then conveying the lint cotton to a lint cleaner, e) feeding a layer of lint cotton to a rotating saw cylinder, f) engaging the layer with a plurality of saw teeth on the saw cylinder, g) moving the layer on the saw teeth of the saw cylinder past at least one stationary grid bar having an elongated edge adjacent said saw teeth, and transverse the saw tooth movement, thereby h) disturbing the lint fibers on the layer of the grid bar edge, and j) loosening foreign matter from the layer;

wherein an improved process for feeding the layer of lint cotton to said saw cylinder comprises the following steps:

k) moving the said layer of cotton through at least one pair of compression feeding rollers, and also l) moving said layer between a pair of final feeding rollers, m) rotating one of said final rollers having a smooth circumferential surface thereof moving in a same direction as the saw cylinder teeth are moving, n) pressing the layer of cotton against the saw teeth by said rotating final roller.

5. The process as defined in claim 4 wherein the saw teeth are moving at a speed of at least twelve times faster than the speed of the surface of said rotating roller.

6. The process as defined in claim 5, wherein the saw teeth are moving at a speed no greater than thirty seven times faster than the speed of the surface of the feed roller.

7. The process as defined in claim 4 wherein the saw teeth are moving at a speed of about twenty five times faster than the speed of the surface of the feed roller.

* * * * *